US008079566B1

(12) United States Patent
Hurst

(10) Patent No.: US 8,079,566 B1
(45) Date of Patent: Dec. 20, 2011

(54) FORM TOOL TO ALIGN PARALLEL CONCRETE FORMS

(76) Inventor: Ralph G. Hurst, Tehachapi, CA (US)

( * ) Notice: Subject to any disclaimer, the term of this patent is extended or adjusted under 35 U.S.C. 154(b) by 439 days.

(21) Appl. No.: 12/475,426

(22) Filed: May 29, 2009

(51) Int. Cl.
*E04G 11/06* (2006.01)
*E04G 17/12* (2006.01)
*E01C 19/50* (2006.01)

(52) U.S. Cl. ..... 249/34; 249/2; 249/216

(58) Field of Classification Search ..... 249/2, 3, 249/4, 5, 6, 7, 8, 34, 208, 210, 216; 269/43, 269/904
See application file for complete search history.

(56) References Cited

U.S. PATENT DOCUMENTS 874,151 A * 12/1907 Zeiser et al. ..... 269/43
1,067,420 A * 7/1913 Forbis ..... 249/5
2,894,310 A * 7/1959 Hogan et al. ..... 249/208
2,965,950 A * 12/1960 Wilson ..... 249/208
3,376,010 A * 4/1968 Myer ..... 249/13
3,389,646 A * 6/1968 Ruggles ..... 249/5
3,458,184 A 7/1969 Schlosser
3,888,477 A 6/1975 Tate
4,420,921 A * 12/1983 Hardin ..... 269/43
4,836,517 A * 6/1989 Vossler ..... 269/904
5,148,605 A 9/1992 Julia
5,156,753 A * 10/1992 Speidel ..... 249/5
5,407,182 A 4/1995 Hartley
D357,854 S 5/1995 Payne
6,705,583 B2 * 3/2004 Daniels et al. ..... 249/34
7,255,319 B2 * 8/2007 Albano ..... 249/34
7,775,499 B2 * 8/2010 Metcalf ..... 249/34

* cited by examiner

*Primary Examiner* — Michael Safavi
(74) *Attorney, Agent, or Firm* — Crossley Patent Law; Mark A. Crossley

(57) ABSTRACT

The concrete form tool apparatus allows a single worker to correctly position inner and outer stem wall forms. The apparatus saves time and labor by allowing a worker to quickly position forms. The apparatus properly positions inner and outer stem wall forms in a parallel relationship, a proper height relationship, and in a proper distance relationship.

8 Claims, 5 Drawing Sheets

FORM TOOL TO ALIGN PARALLEL CONCRETE FORMS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

When preparations are made for constructing a stem wall, two workers are typically needed to align inner and outer forms. The forms have to be at proper height in relation to each other, proper distance in relation to each other, and parallel. This is not an easy task, and, requiring two workers, is time consuming and costly. The present apparatus solves this problem with a two-piece apparatus with telescoping fit, enabling a single worker to quickly position inner and outer forms in relation to each other.

FIELD OF THE INVENTION

The concrete form tool apparatus relates to concrete forms and more especially to an apparatus providing for one worker to set proper spacing and alignment between an inner and an outer concrete stem wall form.

SUMMARY OF THE INVENTION

The general purpose of the concrete form tool apparatus, described subsequently in greater detail, is to provide a concrete form tool apparatus which has many novel features that result in an improved concrete form tool apparatus which is not anticipated, rendered obvious, suggested, or even implied by prior art, either alone or in combination thereof.

To attain this, the concrete form tool apparatus allows a single worker to correctly position inner and outer stem wall forms. The apparatus is ideally made of stainless steel but is also available in other materials, including plastics, polymers, aluminum, and alloys. The apparatus saves time and labor by allowing a worker to quickly position forms. The apparatus properly positions inner and outer stem wall forms in a parallel relationship. The apparatus also properly positions inner and outer stem wall forms in proper height relationship, accounting for differing form heights. Additionally, the apparatus positions inner and outer stem wall forms in a proper distance relationship. The apparatus positions inner and outer forms in a 6 inch spread or an 8 inch spread. Other embodiments are available for various construction situations wherein other form spreads are desirable and accommodated by the apparatus embodiments.

One embodiment provides a 1 9/16 inch spread between the short vertical member and the long vertical member of the inverted J-shaped outer form bracket. The first and second female tubes attached to the outer form bracket are ideally 9/16 inch inside diameter and 3¾ inches in length. The first and second female tubes are ideally about 2 inches apart. The first inner vertical member of the inner form bracket is ideally about 1 9/16 inches apart from the second inner vertical member. These dimensions provide for fit of forms such as 2×4/s and 2×6's.

Various other embodiments, some more basic, are provided. More than one means of affixing the male tube within the female tube is provided. Flat stock may be substituted for the female tubes and the male tube. The handle location is not limited to the inner form bracket.

Thus has been broadly outlined the more important features of the improved concrete form tool apparatus so that the detailed description thereof that follows may be better understood and in order that the present contribution to the art may be better appreciated.

An object of the concrete form tool apparatus is to properly position inner and outer stem wall forms.

Another object of the concrete form tool apparatus is to properly position inner and outer stem wall forms with only one worker.

A further object of the concrete form tool apparatus is to save time and labor.

An added object of the concrete form tool apparatus is to properly position inner and outer stem wall forms in a parallel relationship.

And, an object of the concrete form tool apparatus is to properly position inner and outer stem wall forms in proper height relationship.

Yet another object of the concrete form tool apparatus is to position inner and outer stem wall forms in a proper distance relationship.

These together with additional objects, features and advantages of the improved concrete form tool apparatus will be readily apparent to those of ordinary skill in the art upon reading the following detailed description of presently preferred, but nonetheless illustrative, embodiments of the improved concrete form tool apparatus when taken in conjunction with the accompanying drawings.

In this respect, before explaining the current embodiments of the improved concrete form tool apparatus in detail, it is to be understood that the concrete form tool apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved concrete form tool apparatus. It is therefore important that the claims be regarded as including such equivalent constructions insofar as they do not depart from the spirit and scope of the concrete form tool apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the concrete form tool apparatus generally designated by the reference number 10 will be described.

Figure 1:
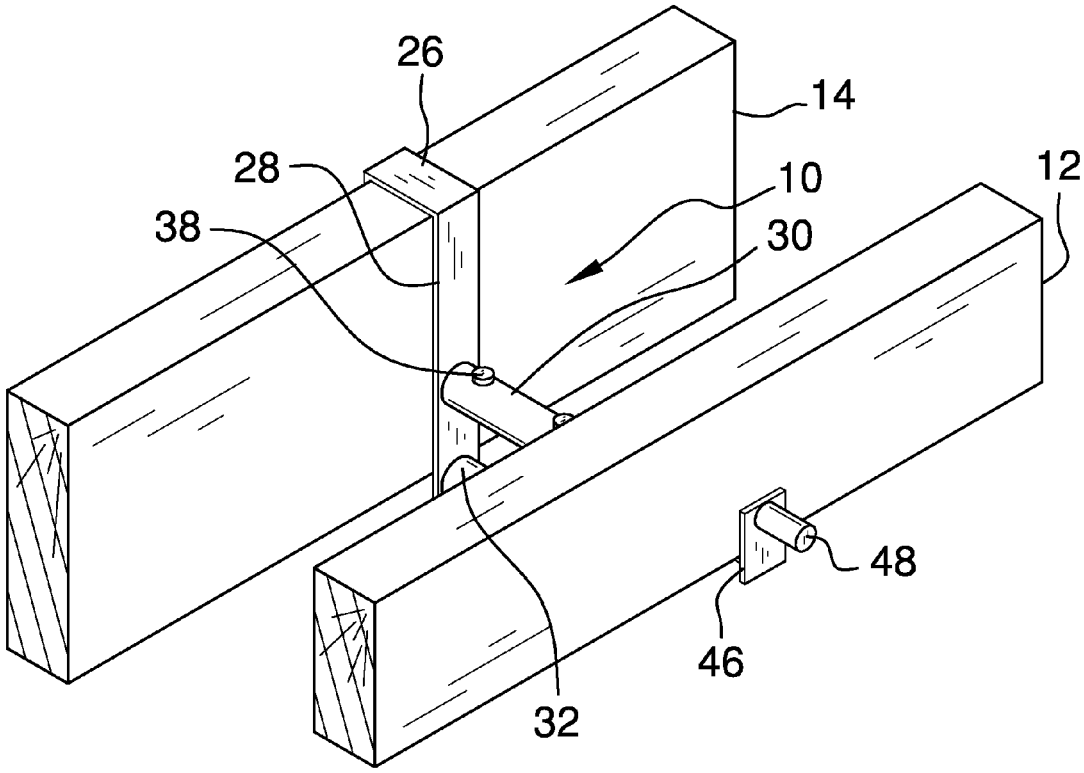
FIG. 1 is a perspective view of the apparatus in use with inner and outer forms.
Figure 3:
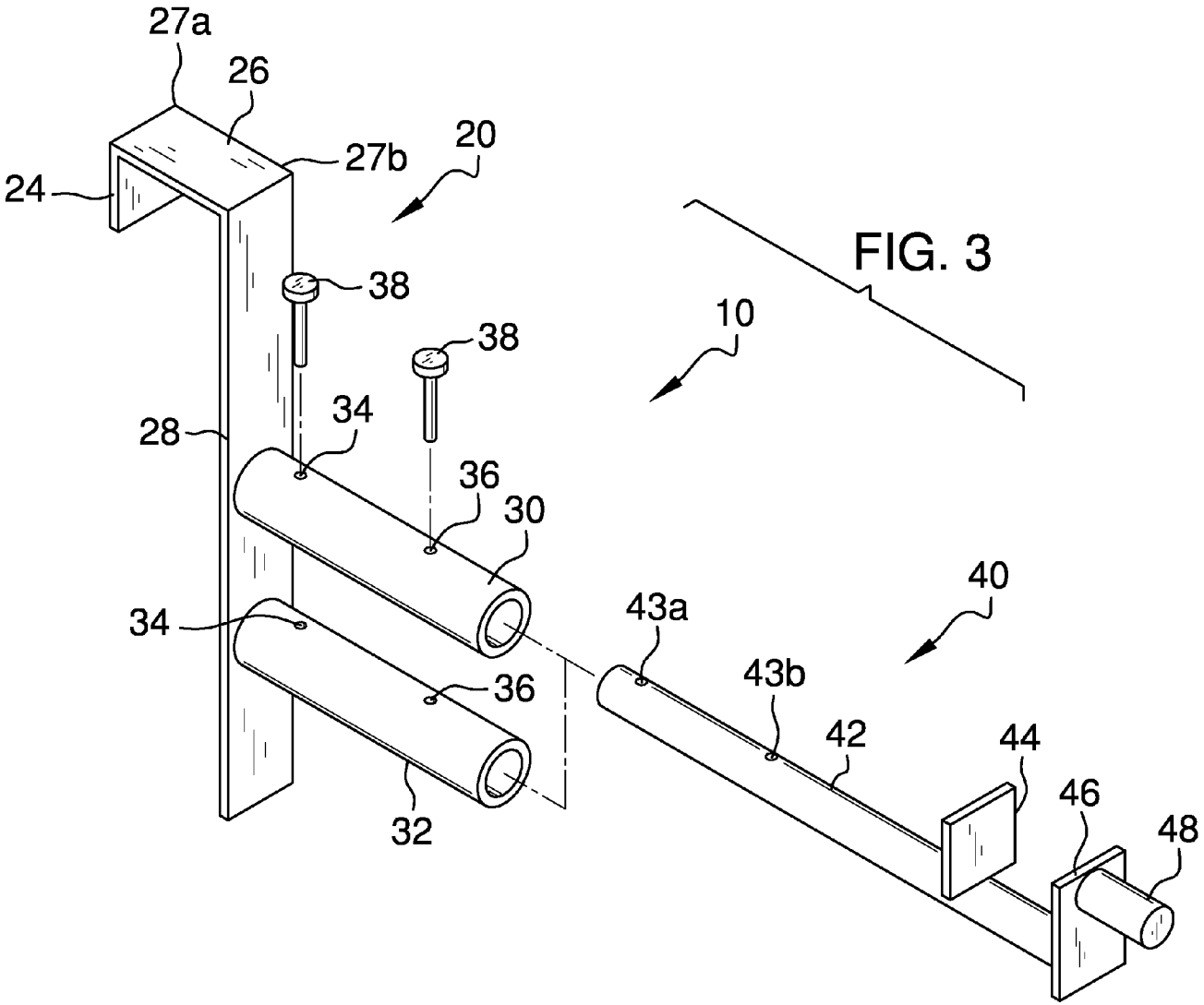
FIG. 3 is a perspective view of the apparatus, the outer form bracket separated from the inner form bracket.

Referring to FIGS. 1 and 3, the apparatus 10 partially comprises an inverted J-shaped outer form bracket 20. The outer form bracket 20 partially comprises the downwardly positioned short vertical member 24. The horizontal member 26 has a first end 27*a* spaced apart from a second end 27*b*. The horizontal member 26 first end 27*a* is attached perpendicularly to the short vertical member 24. The long vertical member 28 is attached perpendicularly downward to the horizontal member 26 second end 27*b*. The long vertical member 28 is parallel to the short vertical member 24. The long vertical member 28 has a length. The first female tube 30 is attached perpendicularly inwardly to about a midpoint of the length of the long vertical member 28. The second female tube 32 is attached perpendicularly inwardly to the long vertical member 28. The second female tube 32 is spaced apart from and parallel to the first female tube 30. The pair of identical spaced apart vertical tube orifices is disposed through each female tube. The tube orifices comprise the first tube orifice 34 and the second tube orifice 36.

Figure 2:
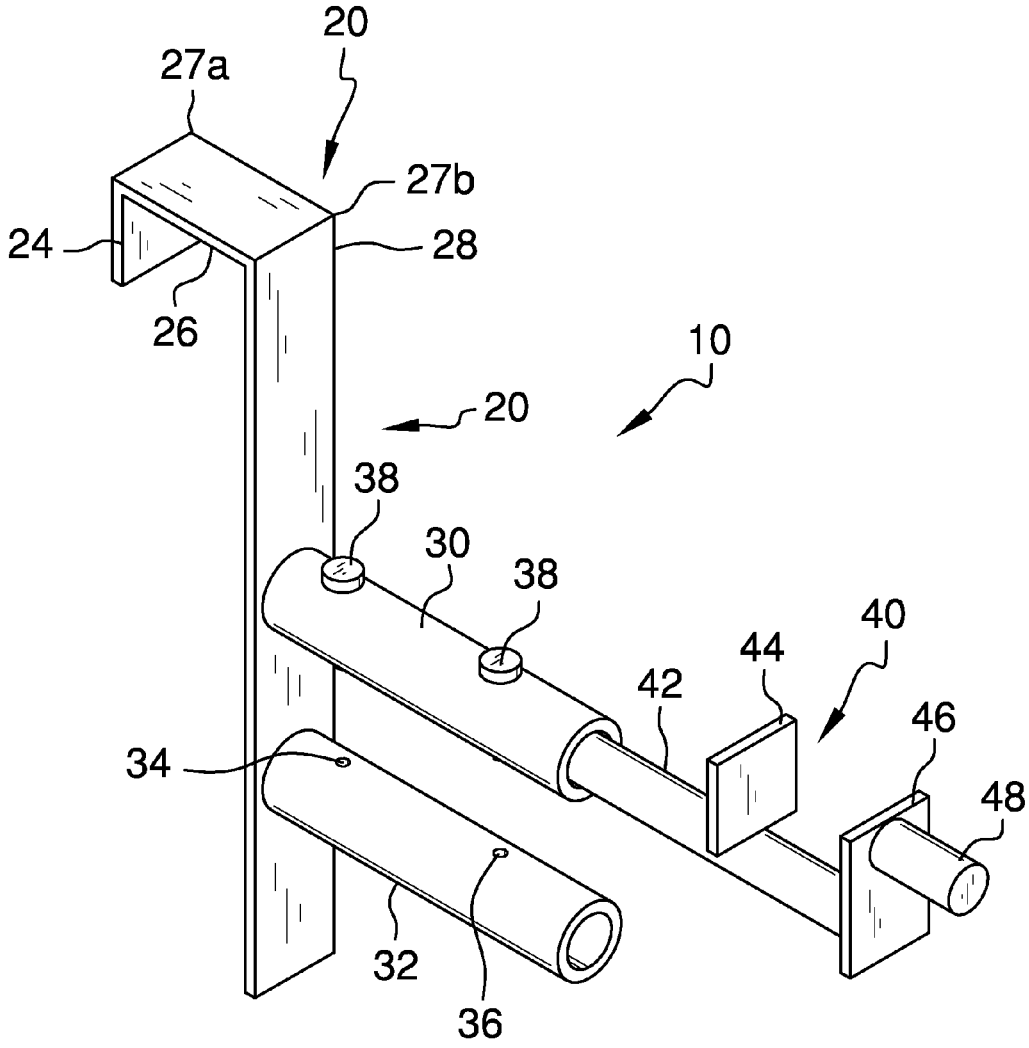
FIG. 2 is a perspective view of the assembled apparatus.

Continuing to refer to FIGS. 1 and 2, the inner form bracket 40 partially comprises the horizontal male tube 42. The male tube 42 is removably and selectively inserted into the first female tube 30. The male tube 42 can also be removably and selectively inserted into the second female tube 32. A pair of spaced apart identical orifices is disposed vertically through the male tube 42. The orifices comprise the first orifice 43*a* and the second orifice 43*b*. The pair of identical pins 38 is removably selectively inserted through the first orifice 43*a* and the second orifice 43*b*. The identical pins 38 are further inserted selectively and removably through the first tube orifice 34 and the second tube orifice 36 of the first female tube 30. The pins 38 may also be selectively and removably inserted through the second female tube 32. The first inner vertical member 44 is affixed atop the male tube 42. The second inner vertical member 46 is affixed outwardly to the end of the male tube 42. The second inner vertical member 46 is parallel to the first inner vertical member 44. The cylindrical handle is affixed outwardly to the second inner vertical member 46.

Referring to FIG. 1, the apparatus 10 is removably positioned over an existing outer 14 and existing inner form 12 in order to position the forms in correct relationship.

Figure 4:
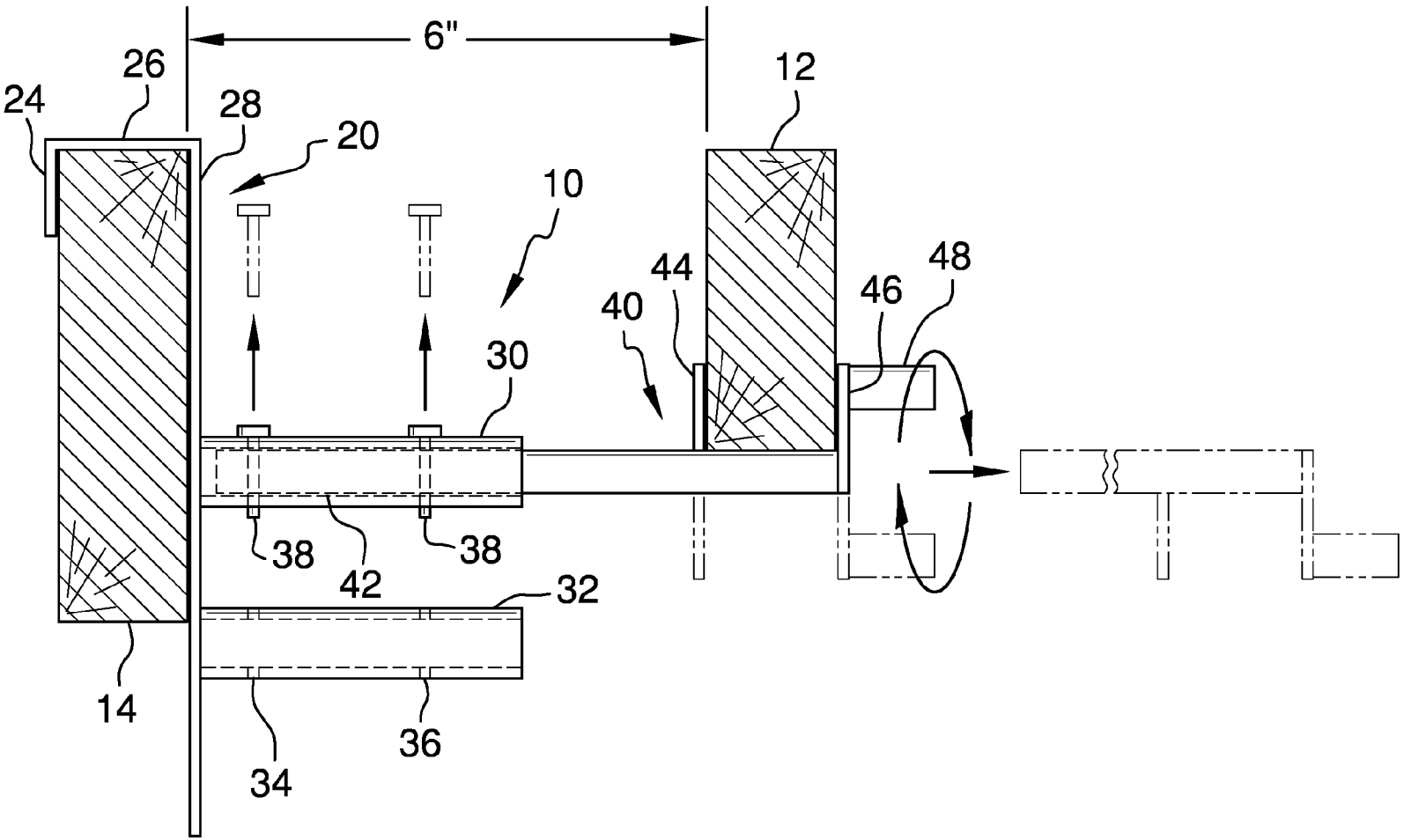
FIG. 4 is a cross sectional lateral view of the apparatus in use with inner and outer forms spaced 6 inches apart.

Referring to FIG. 4, the apparatus is fitted to the inner form 12 and the outer form 14. The male tube 42 is inserted almost fully into the first female tube 30. The inner form 12 is of a shorter height than the outer form 14. Inserting the male tube 42 into the first female tube 30 positions the top of the forms at the same height. The forms are therefore held parallel to each other, positioned at the same height, and spaced 6 inches apart.

Figure 5:
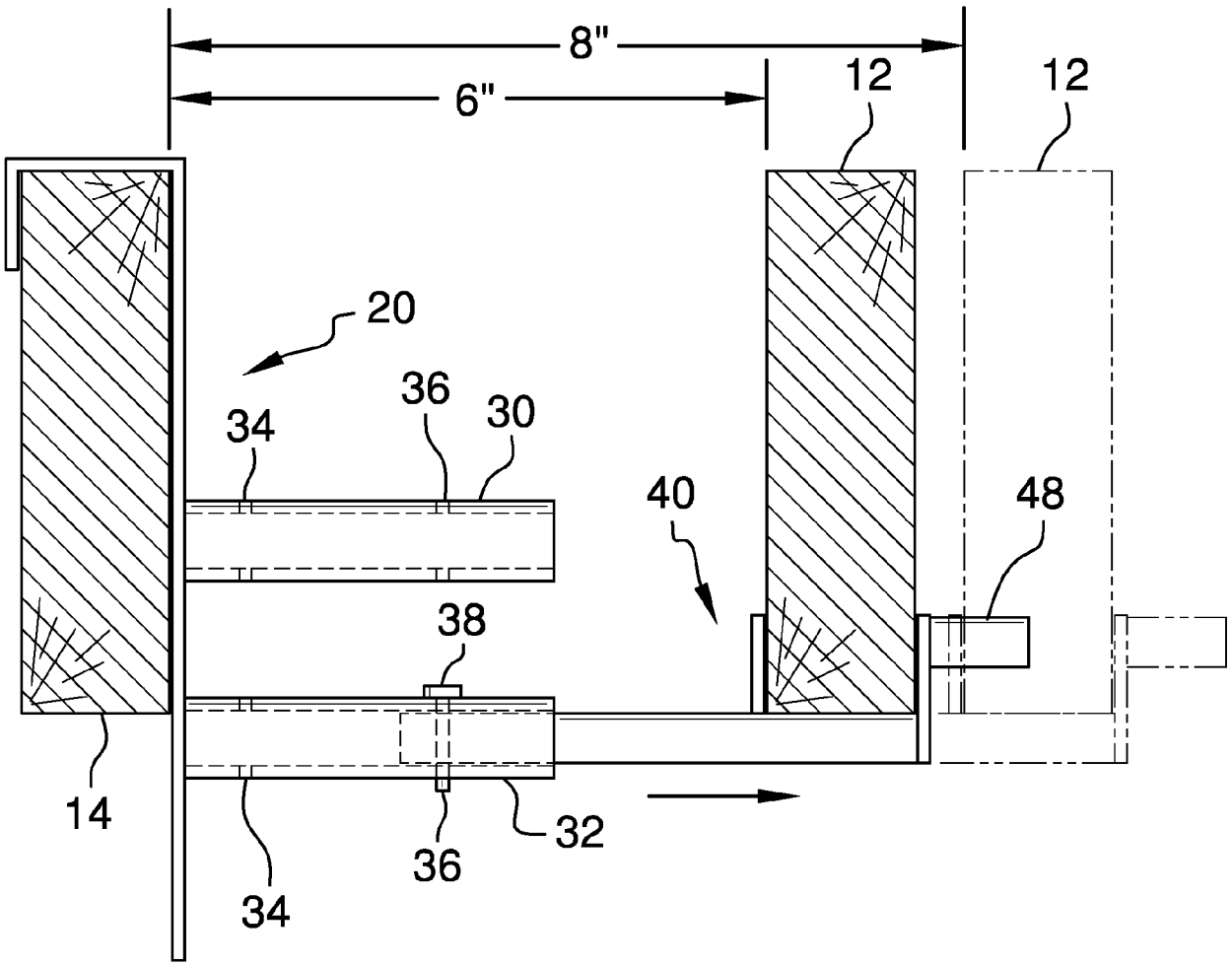
FIG. 5 is a cross sectional view of the apparatus in use with inner and outer forms optional spacing of 6 inches or 8 inches.

Referring to FIG. 5, the example is made with the inner form 12 and outer form 14 having identical heights. The male tube 42 is therefore inserted into the second female tube 32 in order to position the tops of the forms at the same height. Further, the forms can be positioned either 6 inches apart or 8 inches apart. The 8 inch form spread is secured by inserting the pin 38 through the second tube orifice of the second female tube 32 and the first orifice 43*a* of the male tube 42.

With respect to the above description then, it is to be realized that the optimum dimensional relationships for the parts of the concrete form tool apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the concrete form tool apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the concrete form tool apparatus may be used.

Therefore, the foregoing is considered as illustrative only of the principles of the concrete form tool apparatus. Further, since numerous modifications and changes will readily occur to those skilled in the art, it is not desired to limit the concrete form tool apparatus to the exact construction and operation shown and described, and accordingly, all suitable modifications and equivalents may be resorted to, falling within the scope of the concrete form tool apparatus.

What is claimed is:

1. A concrete form tool apparatus, comprising, in combination:

an inverted J-shaped outer form bracket removably positioned over an existing outer form;

an inner form bracket comprising a tube having a pair of spaced apart inner vertical members with a first inner vertical member disposed atop the tube, with a second inner vertical member affixed to an end of the tube an existing outer form removably disposed between the inner vertical members;

means for removably attaching the outer form bracket to the inner form bracket.

2. The apparatus according to claim 1 further comprising a handle.

3. The apparatus according to claim 2 wherein the handle is located on the inner form bracket.

4. The apparatus according to claim 1 wherein the means for removably attaching the outer form bracket to the inner form bracket further comprises at least one pin.

5. The apparatus according to claim 2 wherein the means for removably attaching the outer form bracket to the inner form bracket further comprises at least one pin.

6. The apparatus according to claim 3 wherein the means for removably attaching the outer form bracket to the inner form bracket further comprises at least one pin.

7. The apparatus according to claim 4 wherein the means for removably attaching the outer form bracket to the inner form bracket further comprises at least one pin.

8. A concrete form tool apparatus, comprising, in combination:

an inverted J-shaped outer form bracket removably positioned over an existing outer form, the outer form bracket comprising:

a downwardly disposed short vertical member;

a horizontal member having a first end spaced apart from a second end, the first end attached perpendicularly to the short vertical member;

a long vertical member attached to the horizontal member second end and extending perpendicularly downward, the long vertical member parallel to the short vertical member, the long vertical member having a length;

a first female tube attached to about a midpoint of the length of the long vertical member and extending perpendicularly inwardly;

a second female tube attached to the long vertical member and extending perpendicularly inwardly, the second female tube spaced apart from and parallel to the first female tube;

a pair of identical spaced apart vertical tube orifices disposed through each female tube, comprising a first tube orifice and a second tube orifice;

an inner form bracket comprising:

a horizontal male tube, the male tube removably inserted into the first female tube;

a pair of spaced apart identical orifices disposed vertically through the male tube, the orifices comprising a first orifice and a second orifice;

a pair of identical pins removably selectively inserted through the first orifice and the second orifice, the identical pins further inserted selectively removably through the first tube orifice and the second tube orifice of the first female tube;

a first inner vertical member affixed atop the male tube;

a second inner vertical member affixed outwardly of the first inner vertical member to an end of the male tube, the second inner vertical member parallel to the first inner vertical member;

a cylindrical handle affixed to an outer side of the second inner vertical member.

* * * * *